United States Patent [19]

Chessin et al.

[11] Patent Number: 4,588,481

[45] Date of Patent: May 13, 1986

[54] CHROMIUM PLATING BATH FOR PRODUCING NON-IRIDESCENT, ADHERENT, BRIGHT CHROMIUM DEPOSITS AT HIGH EFFICIENCIES AND SUBSTANTIALLY FREE OF CATHODIC LOW CURRENT DENSITY ETCHING

[75] Inventors: Hyman Chessin, Brick; Kenneth R. Newby, Berkeley Heights, both of N.J.

[73] Assignee: M&T Chemicals Inc., Woodbridge, N.J.

[21] Appl. No.: 716,062

[22] Filed: Mar. 26, 1985

[51] Int. Cl.[4] ..... C25D 3/10

[52] U.S. Cl. ..... 204/51

[58] Field of Search ..... 204/51

[56] References Cited

U.S. PATENT DOCUMENTS 3,311,548 3/1967 Brown et al. ..... 204/51
3,745,097 7/1973 Chessin et al. ..... 204/51
3,804,728 4/1974 Chessin et al. ..... 204/51
3,943,040 3/1976 Willson ..... 204/51

FOREIGN PATENT DOCUMENTS 217166 7/1968 U.S.S.R. ..... 204/51

*Primary Examiner*—G. L. Kaplan
*Attorney, Agent, or Firm*—S. H. Parker; J. Matalon; R. E. Bright

[57] ABSTRACT

A chromium plating bath and process for producing a non-iridescent, adherent, bright chromium deposit at high efficiencies and high temperatures under conditions such that the process is substantially free of cathodic low current density etching. The bath consists essentially of chromic acid and sulfate in predetermined concentrations, and an organic sulfonic acid or salts thereof, where the ratio of S to C is $\geqq \frac{1}{3}$, e.g. methyl, ethyl and propyl sulfonic acid, and methane and 1,2-ethane disulfonic acid. The bath is substantially free of carboxylic acids, phosphonic acids, perfluoroloweralkyl sulfonic acids, and halides.

9 Claims, No Drawings

CHROMIUM PLATING BATH FOR PRODUCING NON-IRIDESCENT, ADHERENT, BRIGHT CHROMIUM DEPOSITS AT HIGH EFFICIENCIES AND SUBSTANTIALLY FREE OF CATHODIC LOW CURRENT DENSITY ETCHING

BACKGROUND OF THE INVENTION

1. Field of the Invention

This invention relates to the electrodeposition of chromium for functional purposes on basis metals from hexavalent chromium plating baths. More particularly, it is concerned with chromium baths which are capable of producing advantageous chromium deposits at high efficiencies and high temperatures without low current density etching.

2. Description of the Prior Art

Typical hexavalent chromium plating baths are described in U.S. Pat. Nos. 2,750,337; 3,310,480; 3,311,548; 3,745,097; 3,654,101; 4,234,396; 4,406,756; 4,450,050 and 4,472,249. These baths are generally intended for either "decorative" chromium plating or for "functional" (hard) chromium deposition. Decorative chromium plating baths are concerned with deposition over a wide plating range so that articles of irregular shape can be completely covered. Functional chromium plating baths, on the other hand, are involved with regularly shaped articles where rapid plating at a high current efficiency and at useful current densities is important.

Functional hexavalent chromium plating baths containing chromic acid and sulfate as a catalyst generally permit the deposition of chromium metal on the basic metal at cathode efficiencies of between 12% and 16% at temperatures between about 52° C. to 68° C. and at current densities of from about 30 to about 50 a.s.d. Mixed catalyst chromic acid plating baths containing both sulfate and fluoride ions generally allow the plating of chromium at higher rates and at cathode efficiencies of between 22% and 26%. The presence of fluoride ion in the bath, however, causes etching of ferrous based metals when the cathode current density is too low to deposit chromium metal, usually below about 5 a.s.d. in fluoride containing baths. This phenomenon is referred to as "low current density etching". Additives for chromium plating baths to prevent low current density etch are described in U.S. Pat. Nos. 2,750,337; 3,310,480; 3,311,548; and 3,654,101. Unfortunately, these additives severely limit the current efficiency of the process.

Some chromium plating baths are designed to impart a decorative iridescence to the deposit. Such baths include hexavalent chromium metal ion, a first additive composition, such as a haloalkyl sulfonic acid or haloalkyl phosphonic acid, and a second additive composition which is a carboxylic acid. The simultaneous action of these two additives in the bath produce the desired iridescent effect. However, there is an accompanying substantial reduction in the current efficiency of the process with these baths.

Other chromium plating baths which use iodide, bromide or chloride ions as additives can operate at a high current efficiency; see U.S. Pat. Nos. 4,234,396; 4,450,050; and 4,472,249; but such baths produce chromium deposits which do not adhere well to the substrate, and which are dull in appearance at high plating temperatures, or only semi-bright when formed at low plating temperatures.

Accordingly, it is an object of the present invention to provide a chromium plating bath for producing non-iridescent, adherent, bright chromium deposits at high cathode efficiencies and at high plating temperatures which are substantially free of low current density etching.

Another object of the invention is to provide a process for producing such advantageous chromium deposits under useful plating conditions.

These and other objects will be made apparent from the following more detailed description of the invention.

SUMMARY OF THE INVENTION

In accordance with the above objects of the invention, there is provided herein a chromium plating bath and process from which a non-iridescent, adherent, bright chromium deposit is obtained at a cathode efficiency of at least 22% at a current density of 77.5 a.s.d. and a bath temperature of 55° C. The process of the invention also is substantially free of cathodic low current density etching.

The plating bath herein consists essentially of chromic acid and sulfate, and an organic sulfonic acid wherein the ratio of S/C is $\geqq \frac{1}{3}$, or salts thereof, as for example, methyl, ethyl and propyl sulfonic acid, and methane and 1,2-ethyl disulfonic acid. The bath is substantially free of deleterious carboxylic acids, phosphonic acids, perfluoroloweralkyl sulfonic acids, and halides.

In the preferred embodiments of the invention, the ratio of the concentration of chromic acid to sulfate is about 25–200, preferably 60–150; and that of chromic acid to the sulfonic acid is 25–450, preferably 40–125.

Boric acid or borates may be included in the bath; they enhance brightness of the deposit without affecting the basic advantageous characteristics of the baths.

DETAILED DESCRIPTION OF THE INVENTION

A typical chromium electroplating bath in accordance with the invention has the following constituents present in g/l.

TABLE 1

| | Suitable | Preferred |
|---|---|---|
| Constituent | | |
| Chromic acid | 100–450 | 200–300 |
| and Sulfate | 1–5 | 1.5–3.5 |
| Organic sulfonic acid | 1–18 | 1.5–12 |
| Optional Constituent | | |
| Boric Acid | 0–40 | 4–30 |
| Operating Conditions | | |
| Temperature (°C.) | 45–70 | 50–60 |
| Current density (a.s.d.) | 11.6–230 | 30–100 |

The effect of using different organic sulfonic acids on plating efficiency is shown below.

TABLE II

| | S/C | Plating Efficiency |
|---|---|---|
| Sulfonic Acids of invention | | |
| Methyl sulfonic acid | 1:1 | 27% |
| Ethyl sulfonic acid | 1:2 | 26% |
| Propyl sulfonic acid | 1:3 | 23% |
| Methane disulfonic acid | 2:1 | 27% |
| 1,2-Ethane disulfonic acid | 1:1 | 26% |
| Sulfonic Acids of Low Efficiency | | |
| t-Butyl sulfonic acid | 1:4 | 20% |

TABLE II-continued

| | S/C | Plating Efficiency |
|---|---|---|
| Trifluoromethyl sulfonic acid | 1:1 | 20% |

The chromium baths of the invention produce very bright, hard ($KN_{100}>900$) adherent, non-iridescent chromium deposits on basis metals in which the plating efficiency in the process is greater than 22% at 77.5 a.s.d. and at a plating temperature of 55° C., with substantially no accompanying low current density etching.

The preferred bath compositions of the invention are those in which the organic sulfonic acid is methyl sulfonic acid which provide plating efficiencies in the range of 24–28%. When ethyl sulfonic acid is substituted for methyl sulfonic acid, the plating efficiency still is 26%, while for propyl sulfonic acid it is 23%. However, the use of alkyl sulfonic acids which have an S/C ratio of less than the desired $\frac{1}{3}$, e.g. t-butyl sulfonic acid, S/C ratio of $\frac{1}{4}$ results in a substantially reduced efficiency of only 20%. A similar low efficiency also is obtained with a perfluoroloweralkyl sulfonic acid of less than four carbon atoms, for example, trifluoromethyl sulfonic acid.

While certain sulfonic acids or their salts are prescribed herein, it will be understood that reduced precursor forms thereof, such as the corresponding thiols, also may be used, since these compounds will oxidize in the presence of chromic acid to the desired sulfonic acid.

Boric acid or borates are optionally includable in the baths of this invention since they enhance brightness without affecting efficiency.

Those ingredients which normally are added to electroplating baths for specific purposes may be included, as for example, fume suppressants.

The ratio of the concentration of chromic acid to sulfonate in the bath of this invention suitably ranges from 25 to 450, preferably 40–125, and optimally about 70.

The ratio of the concentration of chromic acid to sulfate suitably ranges from 25 to 200, preferably 60–150, and optimally about 100.

The bath of the invention is substantially free of deleterious ions. For example, the inclusion in the bath of even small amounts, e.g. 10 g/l of a carboxylic acid, such as acetic acid or succinic anhydride, results in a grey and/or rough deposit, which is unacceptable. Furthermore, halogen, in the form of a halide ion, such as $Br^-$ or $I^-$, in amounts of 1 g/l or more should be excluded since they produce a rough deposit and reduced cathodic efficiencies. $F^-$ and $Cl^-$ also should be excluded because they cause low current etching. Phosphonic acids also materially affect current efficiencies to unacceptable levels.

What is claimed is:

1. A functional chromium plating process for producing a non-iridescent, adherent, bright chromium deposit on a basis metal at a cathode efficiency of at least 22% at a current density of 77.5 a.s.d. and a plating temperature of 55° C., which deposit is substantially free of grey or rough deposits or low current density etching, comprising electroplating chromium on said metal at a temperature of 45°–70° C. from a chromium plating bath consisting essentially of chromic acid and sulfate, and a non-substituted alkyl sulfonic acid, or salt thereof, wherein the ratio of S/C is $\geqq\frac{1}{3}$.

2. A functional chromium plating process as defined in claim 1 wherein said bath is substantially free of a carboxylic acid, a dicarboxylic acid, a phosphonic acid, a perfluoroloweralkyl sulfonic acid, and a halide.

3. A functional chromium plating process as defined in claim 1 in which plating is carried out at a temperature of about 50°–60° C.

4. A functional chromium plating process as defined in claim 1 in which the ratio of the concentration of chromic acid to sulfate is 25–200.

5. A functional chromium plating process as defined in claim 4 in which said ratio is 60–150.

6. A functional chromium plating process as defined in claim 1 in which the ratio of the concentration of chromic acid to sulfonic acid is 25–450.

7. A functional chromium plating process as defined in claim 1 in which plating is carried out at a current density of 11.6 to 230 a.s.d.

8. A functional chromium plating process as defined in claim 7 in which said current density is 30–100 a.s.d.

9. A functional chromium plating process as defined in claim 1 wherein said bath also includes boric acid or a borate in a concentration of about 4–40 g/l.

* * * * *